US005328716A

United States Patent [19]

Buchanan

[11] Patent Number: 5,328,716

[45] Date of Patent: Jul. 12, 1994

[54] METHOD OF MAKING A COATED ABRASIVE ARTICLE CONTAINING A CONDUCTIVE BACKING

[75] Inventor: Scott J. Buchanan, Minneapolis, Minn.

[73] Assignee: Minnesota Mining and Manufacturing Company, St. Paul, Minn.

[21] Appl. No.: 928,845

[22] Filed: Aug. 11, 1992

[51] Int. Cl.[5] ..... B05D 5/12

[52] U.S. Cl. ..... 427/121; 51/295

[58] Field of Search ..... 51/295; 427/121

[56] References Cited

U.S. PATENT DOCUMENTS

| | | | |
|---|---|---|---|
| Re. 29,808 | 10/1978 | Wagner | 51/401 |
| 2,004,466 | 6/1935 | Dietz et al. | 51/280 |
| 2,404,207 | 7/1946 | Ball | 51/188 |
| 3,163,968 | 1/1965 | Nafus | 51/394 |
| 3,166,388 | 1/1965 | Riegger et al. | 51/296 |
| 3,168,387 | 2/1965 | Adams | 51/295 |
| 3,367,851 | 2/1968 | Filreis et al. | 204/2 |
| 3,377,264 | 4/1968 | Duke et al. | 204/290 |
| 3,619,150 | 11/1971 | Rinker | 51/295 |
| 3,942,959 | 3/1976 | Markoo et al. | 51/295 |
| 3,992,178 | 11/1976 | Markoo et al. | 51/295 |
| 4,347,104 | 8/1982 | Dressler | 162/103 |
| 4,652,275 | 3/1987 | Bloecher et al. | 51/298 |
| 4,696,835 | 9/1987 | Maus et al. | 427/121 |
| 4,826,508 | 5/1989 | Schwartz et al. | 51/293 |
| 4,909,901 | 3/1990 | McAllister et al. | 162/125 |
| 4,973,338 | 11/1990 | Gaeta et al. | 51/295 |
| 5,061,294 | 10/1991 | Harmer et al. | 51/295 |
| 5,108,463 | 4/1992 | Buchanan | 51/295 |
| 5,137,542 | 8/1992 | Buchanan et al. | 51/295 |
| 5,232,468 | 8/1993 | Broberg et al. | 51/295 |
| 5,236,472 | 8/1993 | Kirk et al. | 51/295 X |
| 5,250,085 | 10/1993 | Mevissen | 51/295 X |
| 5,254,194 | 10/1993 | Ott et al. | 51/295 X |
| 5,256,170 | 10/1993 | Harmer et al. | 51/295 X |

FOREIGN PATENT DOCUMENTS

| | | |
|---|---|---|
| 67400/74 | 2/1975 | Australia . |
| 61-152373 | 7/1986 | Japan . |
| 885192 | 12/1961 | United Kingdom . |
| 2018811 | 10/1979 | United Kingdom . |

OTHER PUBLICATIONS

Japanese Abstract No. 58-177270 (Inoue), Oct., 1983.

*Primary Examiner*—Michael Lusignan

*Attorney, Agent, or Firm*—Gary L. Griswold; Walter N. Kirn; Gregory D. Allen

[57] ABSTRACT

A method of making a coated abrasive article having an electrically conductive backing is taught, wherein electrically conductive material is incorporated into a coated abrasive backing. The coated abrasive article made by this method has a reduced tendency to accumulate static electric charge in the abrasive article during abrading of a workpiece.

17 Claims, No Drawings

METHOD OF MAKING A COATED ABRASIVE ARTICLE CONTAINING A CONDUCTIVE BACKING

FIELD OF THE INVENTION

This invention pertains to a method of making a coated abrasive article having a backing and an abrasive layer attached to a major surface thereof, the method including the step of impregnating the backing with an impregnating composition comprising an electrically conductive material. The resulting abrasive article is useful in reducing the accumulation of the static electric charge in the coated abrasive article during abrading of a workpiece.

DESCRIPTION OF THE RELATED ART

In the typical manufacturing process of coated abrasives, a first binder precursor, typically referred to as a make coat precursor, is applied to the front side of a backing. Next, a plurality of abrasive granules are projected into the make coat precursor and then the make coat precursor is at least partially cured. A size coat precursor is applied over the abrasive granules. Then the size coat precursor and, if necessary, the make coat precursor are fully cured to form a size coat and a make coat. The purpose of the make coat is to secure the abrasive granules to the backing. The purpose of the size coat is to further reinforce the abrasive granules. In a common alternative method for making coated abrasives, an abrasive layer is applied to the front side of a backing by slurry coating a slurry comprising a binder precursor and abrasive granules. The binder precursor is then cured. Typically, the curing process is done by thermal energy.

For fibrous coated abrasive backings such as paper or nonwovens, the thermal curing tends to remove too much moisture from these backings causing them to become undesirably brittle and stiff. To alleviate this problem, after the make and size coats are thermally cured, the fibrous backing is saturated with water such that moisture is reintroduced into the fibrous backing to prevent the embrittlement problem. This process is referred to in the industry as "backtreating."

Coated abrasives unfortunately suffer from the generation of static electricity during their use for abrading and finishing wood and wood-like materials. Static electricity is generated by the constant separation of the abrasive product from the workpiece, the machinery drive rolls, idler rolls, and support pad for the abrasive product. The static electric problems tend to be more pronounced when abrading electrically insulating or semi-insulating workpieces, for example, wood (e.g., pine, oak, cherry, etc.), plastic, mineral (e.g., marble), the like (e.g., particle board or pressed board), or workpieces coated with an insulating material (e.g., lacquer). This static charge is typically on the order of 50 to 500 kilovolts.

Static electricity is responsible for numerous problems. For example, a sudden discharge of the accumulated static charge can cause injury to an operator in the form of an electric shock or it can cause the ignition of wood dust particles, which poses a serious threat of fire or explosion. The static charge also causes the sawdust to cling to various surfaces, including that of the coated abrasive, the abrading machine, and the electrically insulating wood workpiece, thereby making it difficult to remove by use of a conventional exhaust system. If the static electrical charge is reduced or eliminated, the coated abrasive article can have a significantly longer useful life and the potential for the above-mentioned hazards can be reduced.

Many attempts, with varying degree of success, have been made to solve the static electricity problem. one common approach has been to incorporate an electrically conductive or antistatic material into the coated abrasive construction to eliminate the accumulation of electrical charge. For example, U.S. Pat. No. 3,163,968 (Nafus) discloses a coated abrasive article having a coating comprising graphite in the binder on the surface opposite the abrasive material. U.S. Pat. No. 3,168,387 (Adams) discloses a coated abrasive having a metal leaf pigment over the abrasive grains. U.S. Pat. No. 3,377,264 (Duke) discloses an electrically conductive layer, such as a metal foil, overlying the front surface of a coated abrasive.

U.S. Pat. No. 3,942,959 (Markoo et al.) teaches a coated abrasive construction having an electrically conductive resin layer sandwiched between two electrically nonconductive resin layers to prevent the accumulation of electrostatic charge during grinding. In the latter construction, the resin layer is made electrically conductive by incorporating into the resin an electrically conductive filler which may be a metal alloy, metal pigment, metal salt, or metal complex.

U.S. Pat. No. 3,992,178 (Markoo et al.) discloses a coated abrasive article having an outer layer comprised of graphite particles in a bonding resin which reduces the electrostatic charges generated during grinding.

U.S. Pat. No. 5,061,294 (Harmer et al.) teaches a coated abrasive that is rendered electrically conductive by the addition of a doped conjugated polymer.

U.S. Pat. No. 5,108,463 (Buchanan) discloses including carbon aggregates in the coated abrasive bond system. The presence of the carbon black aggregates reduces the static electricity generated during abrading.

PCT Appln. No. WO 92/02336, published Feb. 20, 1992, teaches a coated abrasive article having a printed coating of electrically conductive ink incorporated in the construction thereof.

U.S. Pat. No. 4,826,508 (Schwartz et al.) discloses a flexible abrasive member comprising a length of flexible fabric that has been treated to render it electrically conductive, an electrically non-conductive mesh layer applied to one surface of the fabric, the non-conductive mesh layer having a multitude of discrete openings therein, and electrodeposited metal adhering to the electrically conductive fabric in each of the openings, the electrodeposited metal having particulate abrasive material embedded therein.

Japanese Patent Application No. 63169270, published Jul. 13, 1988, discloses a lapping film or polishing tape having a base film, carbon black, alumina abrasive, and a binder. A cationic antistatic agent is present either in the binder or on the binder.

U.S. Pat. No. 4,973,338 (Gaeta et al.) discloses a coated abrasive article having improved anti-static, lubricity, and antiloading properties. The coated abrasive has a supersize coating comprising a quaternary ammonium compound, which has from about 15 to 35 carbon atoms and a molecular weight not less than about 300. Examples of the quaternary ammonium compound are said to include (3-lauramido-propyl) trimethylammonium methyl sulfate, stearamidopropyldimethyl-beta-hydrooxyethyl-ammoniumnitrate, N,N-bis(2-hydroxyethyl)-n-(3'1-dodecyloxy-2'-hydroxypropyl)-methylammonium methosulfate, and ammoniumdihydrogen phosphate. The quaternary ammonium compound is coated out of a solvent, typically an alcohol solvent.

SUMMARY OF THE INVENTION

The present invention provides a method of making a coated abrasive article having a reduced tendency to accumulate static electric charge during the abrading of a workpiece, the method comprising the steps of:

(a) providing a coated abrasive article comprising a backing having a front surface bearing an abrasive layer, and a porous back surface;

(b) impregnating the porous back surface so as to penetrate at least 0.005 mm into the thickness of the backing with an impregnating composition comprising electrically conductive material and liquid to provide on removal of at least a portion of the liquid, a coated abrasive article having a reduced tendency to accumulate static electric charge during the abrading, preferably, the impregnating composition being essentially free of binder adhesive; and (c) at least partially removing a sufficient amount of the liquid to provide the coated abrasive article (preferably, the coated abrasive article resulting from step (c) has a backing having an exposed porous back surface), with the proviso that if the impregnating composition is a solvent solution of soluble electrically conductive material, the coated abrasive article resulting from step (c) has a backing having an exposed porous back surface.

The backing can be woven or nonwoven. Preferably, the backing is a nonwoven backing made of cellulose fibers. Typically, the thickness of a nonwoven cellulosic backing is in the range from about 0.2 to about 0.4 mm. Preferably, the nonwoven backing has a thickness in the range from about 0.3 to about 0.35 mm.

Typically, the electrically conductive material penetrates at least 2 percent of the thickness of the backing. Preferably, the electrically conductive material penetrates at least 5 percent of the thickness of the backing, even more preferably, at least 10 percent, more preferably, at least 20 percent, and most preferably, at least 30 percent.

Preferably, the impregnating composition, which preferably is essentially free of binder adhesive material normally employed in the construction of coated abrasive products, is selected from the group consisting of a dispersion comprising a liquid vehicle and a plurality electrically conductive particles, a solution comprising solvent and soluble electrically conductive material, and combinations thereof.

The term "nonwoven backing" as used herein refers to a paper or fabric made from staple lengths of cellulose (e.g., derived from seed (e.g., cotton) or wood (e.g., coniferous and deciduous), rayon, aramid, glass, thermoplastic synthetic (e.g., polyester, polyamide, and polypropylene) fibers mechanically positioned in a random manner, typically bonded with a synthetic adhesive or rubber latex.

The term "porous" as used herein means that the back surface of the backing is sufficiently porous such that the impregnating composition can penetrate at least 0.005 mm into the thickness of a backing.

The phrase "penetrates at least 2 percent of the thickness of the backing" means that at least some of the electrically conductive material is incorporated into the backing (i.e., at least to a depth equal to 2 percent of the thickness of the backing) as opposed to simply being on a surface of the backing. In other words, a cross-section of a 0.3 mm thick backing, for example, reveals that electrically conductive material is present at least 0.015 mm from the back surface of the backing.

Preferably, the backing of a coated abrasive prepared in accordance with the present invention comprises in the range from about 2 to about 10 percent by weight of electrically conductive material, based on the combined weight of the backing and the electrically conductive material.

The coated abrasive may be in any conventional form including those having an abrasive layer comprising a make layer, abrasive granules, a size layer, etc., and other functional layers (e.g., a supersize layer) and those having a monolayer as an abrasive layer comprising a slurry layer comprising a bond system and abrasive granules, and other functional layers. The backing of the coated abrasive optionally has a presize coating, a backsize coating, a saturant, or combinations thereof.

The present invention provides a convenient method for making a coated abrasive article having a reduced tendency to accumulate static electric charge during the abrading of a workpiece. Further, one method according to the present invention does not require an extra processing step(s) because paper or cotton backings are typically backtreated.

DETAILED DESCRIPTION OF PREFERRED EMBODIMENTS

This invention pertains to a method for making a coated abrasive article having an electrically conductive backing, wherein the backing is made electrically conductive by impregnating electrically conductive material therein.

Suitable backings include those known in the art (e.g., conventional paper backings, cotton backings, and aramid backings (e.g., described in U.S. Pat. No. 5,083,650 (Seitz et al.) and commercially available, for example, under the trade designation "KEVLAR MAT" from International Paper of Tuxedo, N.Y.)).

The preferred liquid vehicle is water. The preferred solvent is organic liquid. Suitable organic liquids include, for example, mineral spirits, alcohols, mineral oil, acetone, glycols, and xylene.

Suitable electrically conductive particles include those made of graphite, carbon black, hygroscopic salts (e.g. a quaternary salt, including that commercially available under the trade designation "EMERSTAT 6660A" from Emery Chemicals of Cincinnati, Ohio) N,N bis (2-hydroxyethyl)-N-(3'dodecyloxy-2'-dodecyloxy-2'-hydroxypropyl) methylammonium methosulfate (commercially available as a solution, for example, from the American Cyanamid Company of Wayne, N.J., under the trade designation "CYSTAT 609"), stearamidopropyldimethyl-hydroxyethylammonium-dihydrogen phosphate (commercially available as a solution, for example, from the American Cyanamid Company under the trade designation "CYSTAT SP"), stearamidopropyldimethyl B-hydroxyethylammonium nitrate (commercially available as a solution, for example, from the American Cyanamid Company under the trade designation "CYSTAT SN"), and (3-lauramidopropyl) trimethylammonium methylsulfate (commercially available, for example, under the trade designation "CYSTAT LS" from the American Cyanamid Company)), electrically conductive polymers (e.g., polypyrrole), and combinations thereof. For further details regarding hygroscopic salts, see U.S. Pat. No. 4,973,338 (Gaeta et al.) the disclosure of which is incorporated herein by reference.

A preferred combination of electrically conductive materials is a hygroscopic salt and a humectant. Suitable humectants include, for example, glycerol, polyglycols, polyethylene glycols, polyethers, and polymers of alkylene oxides.

The weight percent electrically conductive material comprising the dispersion or solution depends on the type or the specific electrically conductive material used.

The dispersion or the solution may further comprise other additives such as dispersion aids (e.g., sulfonated sodium lignosulfonates, neutralized salts of condensed naphthalene sulfonic acid, and anionic polymerized naphthalene sulfonate), wetting agents, surfactants, dyes, pigments, suspension agents, processing agents, coupling agents, and combinations thereof. Suitable dispersion aids include those marketed under the trade designations "LOWAR PWA" and "NOPCOSPERSE A-23" from Henkel Corp. of Ambler, Pa., and "DAXAD 11G" from W. R. Grace & Co. of Lexington, Mass.

The electrically conductive particles can be in any of a variety of shapes provided the particles can be dispersed and impregnated into the porous backing. For example, fibrous electrically conductive material tends to have poor penetration into the porous surface of the backing. Graphite particulate typically has an average diameter in the range from about 0.5 to about 15 micrometers. Preferably, the average diameter of the graphite particulate is in the range from about 0.5 to about 1.5 micrometer. Carbon black typically has an average diameter in the range from about 10 to about 90 nm. Preferably, the carbon black particulate has an average diameter in the range from about 10 to about 60 nm, and, more preferably, about 10 to about 40 nm. If the size of the electrically conductive material is too large, it is difficult to properly disperse the material in the liquid vehicle. If the size of the electrically conductive material is too small, the viscosity of the dispersion may become excessively high.

The viscosity of the dispersion or solution comprising the electrically conductive material is typically similar to that of the liquid used for the dispersion or solution. For example, the viscosity of water is 0 cps at 25° C. The viscosity of a dispersion or solution with water as the liquid at 25° C. is typically about 0 to about 100 cps, as determined using a "BROOKFIELD VISCOMETER" (Brookfield Engineering Laboratories, Inc., Stoughton, Mass.) with an LV No. 1 spindle at 60 rpm.

The dispersion or the solution comprising electrically conductive material can be applied to the backing using any suitable means including brush coating, spray coating, dip coating, roll coating, curtain coating, die coating, knife coating, transfer coating, gravure coating, and kiss coating. Spray coating and roll coating are the preferred means for applying the dispersion or solution to the backing. Preferably, the dispersion or solution is applied to the backing after at least one binder layer (e.g., make coat or slurry coat) has been applied.

A fibrous, cellulosic backing, for example, typically requires the presence of a sufficient amount of water in the cellulosic material to provide a suitably flexible (i.e., non-brittle) coated abrasive article. Thus, if the dispersion or the solution applied to the backing comprises water, it is preferable to remove only a portion of the water. If too much liquid is removed from the backing, the backing tends to become undesirably brittle.

The electrically conductive backing may further comprise at least one of a presize (i.e., a barrier coat overlying the major surface of the backing onto which the abrasive layer is applied), a backsize (i.e., a barrier coat overlying the major surface of the backing opposite the major surface onto which the abrasive layer is applied), and a saturant (i.e., a barrier coat that is coated on all exposed surfaces of the backing). Preferably, the electrically conductive backing comprises a presize. Suitable presize, backsize, or saturant materials are known in the art. Such materials include, for example, lattices, neoprene rubber, butylacrylate, styrol, starch, hide glue, and combinations thereof.

Typically, the surface electrical resistance of the backing is less than about 5,000 kilo-ohms/square. Preferably, the surface resistivity of the backing is less than about 2,000 kilo-ohms/square. More preferably, the surface resistivity of the backing is less than about 1,000 kilo-ohms/square, and most preferably it is less than about 500 kilo-ohms/square. Suitable ohmmeters are commercially available and include, for example, those available under the trade designations "Beckman Industrial Digital Multimeter," Model 4410 from Beckman Industrial Corp. of Brea, Calif.; and "Industrial Development Bangor Surface Resistivity Meter," Model 482 from Industrial Development Ltd. of Bangor Gwynned, Wales.

Some electrically conductive backings may have the electrically conductive material incorporated therein such that a major surface of the backing does not have an electrical resistivity less than about 5,000 kilo-ohms/square. However, when an abrasive article prepared in accordance with the present invention is used, one skilled in the art will readily realize that the backing is sufficiently electrically conductive because the static electricity will be dissipated.

With the exception of the method steps of incorporating electrically conductive material into the backing of a coated abrasive article, conventional materials and techniques known in the art for constructing coated abrasive articles can be used.

The preferred bond system is a resinous or glutinous adhesive. Examples of typical resinous adhesives include phenolic resins, urea-formaldehyde resins, melamine-formaldehyde resins, epoxy resins, acrylate resins, urethane resins, and combinations thereof. The bond system may contain other additives which are well known in the art, such as, for example, grinding aids, plasticizers, fillers, coupling agents, wetting agents, dyes, and pigments.

Preferably, the abrasive granules are selected from such known grains as fused aluminum oxide, heat-treated aluminum oxide, ceramic aluminum oxide, cofused alumina-zirconia, garnet, silicon carbide, flint, ceria, diamond, cubic boron nitride, and combinations thereof. The term abrasive granules is meant to include abrasive agglomerates, which are shaped masses comprising abrasive granules bonded together by means of a bond system. Examples of such abrasive agglomerates are taught in U.S. Pat. No. 29,808 (Wagner) and U.S. Pat. No. 4,652,275 (Bloecher et al.), the disclosures of which are incorporated herein by reference.

The coated abrasive may also contain a supersize coat. The purpose of the supersize coat is to reduce the amount of loading. "Loading" is the term used to describe the filling of spaces between abrasive grains with swarf (the material removed from the workpiece) and the subsequent build up of that material. For example, during wood sanding, swarf comprised of wood particles becomes lodged in the spaces between abrasive grains, dramatically reducing the cutting ability of the grains. Typical supersizes include, for example, those comprising metal salts of fatty acids, urea-formaldehyde, novolak phenolic resins, waxes, and mineral oils. Preferably, the supersize coat comprises a metal salt of a fatty acid, such as zinc stearate.

In the first preferred conventional method for preparing a coated abrasive article, a make coat is applied to a major surface of a backing followed by projecting a plurality of abrasive grains into the make coat (e.g., drop coating or electrostatically coating). It is preferable in preparing the coated abrasive that the abrasive grains be electrostatically coated. The make coating is cured in a manner sufficient to at least partially solidify it such that a size coat can be applied over the abrasive grains. Next, the size coat is applied over the abrasive grains and the make coat. Finally, the make and size coats are fully cured. Optionally, a supersize coat can be applied over the size coat and cured.

The make coat can be applied to the backing using any conventional means including, for example, roll coating, curtain coating, die coating, spray coating, and transfer coating. The size coat can be applied using any conventional means such as roll coating, curtain coating, and spray coating.

In the second preferred conventional method for preparing a coated abrasive article having a slurry coated abrasive layer, a slurry which contains abrasive grains dispersed in a bond material is applied to a major surface of a backing. The bond material is then cured. Optionally, a supersize coat can be applied over the slurry coat and cured.

In the above methods, the make coat and size coat or slurry coat can be solidified or cured by means known in the art, including, for example, air drying, thermal energy, radiation energy, and combinations thereof. Specific examples of radiation energy include electron beam, ultraviolet light, and visible light.

The coated abrasive article is typically flexed using conventional techniques prior to use. A coated abrasive article prepared according to the method of the present invention can be flexed any convenient time after the bond system (e.g., make and size coats or slurry coats) has been cured (i.e., the coated abrasive article can be flexed before, during, or after the impregnation of the dispersion or solution).

The incorporation of the electrically conductive backing into the coated abrasive construction provides certain desirable antistatic properties. Although not wanting to be bound by theory, it is believed that the electrically conductive coated abrasive prepared in accordance with the method of the present invention rapidly dissipates static electricity generated during the abrading of a workpiece. When the static electricity is dissipated, the workpiece dust particles generated in the abrading operation are typically removed by a conventional exhaust system. If the static electricity is not dissipated, the workpiece dust particles carry a charge, and may not be removed as readily by the exhaust system.

The present invention provides a coated abrasive article which provides a solution to the serious static electricity build-up problem associated with abrading a workpiece with a coated abrasive article.

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

Procedures for Testing the Coated Abrasive

The coated abrasive belt was installed on an Oakley Model D Single Belt Stroke Sander. The coated abrasive belt abraded three red oak workpieces for five minutes each. The pressure at the interface was approximately 0.20 Newtons/square centimeter. The belt speed corresponded to about 1670 surface meters per minute. The amount of red oak removed (cut) was measured and the amount of dust (swarf) collected on metal plate immediately past the workpiece holder was determined. The amount of red oak removed was divided by the amount of dust collected to generate a dimensionless "Dust Efficiency Factor" (DEF). High values of the DEF indicate that the production of dust uncollected by the exhaust system was low.

Example 1

Solution I was prepared by mixing about 50 grams of a quaternary salt (commercially available under the trade designation "EMERSTAT 6660A" from Emery Chemicals of Cincinnati, Ohio) in about 150 grams of isopropanol.

The back side of a grade P150, E weight coated abrasive belt commercially available under the trade designation "3M 241 RESINITE" from the 3M Company of St. Paul, Minn., was saturated (impregnated) with Solution I. The resulting article was dried for about 15 minutes at about 66° C., and then rehumidified for about 30 minutes at about 45% relative humidity.

The coated abrasive article was then tested as described above in "Procedures for Testing the Coated Abrasive." The results are provided in Table 1, below.

Control Example A

Control Example A was prepared and tested as described in Example 1 except Solution I was applied onto the abrasive layer of a grade 180 paper belt (commercially available under the trade designation "3M 451 RESINITE" from the 3M Company). The results are provided in Table 1, below.

Control Example B

Control Example B was a grade P180, E weight coated abrasive belt commercially available under the trade designation "3M 240 RESINITE" from the 3M Company. The test results are provided in Table 1, below.

TABLE 1

| Example | Cut, grams | Dust collected, grams | DEF |
|---|---|---|---|
| 1 | 397 | 10 | 40 |
| Control A | 132 | 3 | 44 |
| Control B | 477 | 25 | 19 |

It can be seen from the above data that the use of the electrically conductive material significantly increased the Dust Efficient Factor of a coated abrasive article.

Examples 2–6

Examples 2–6 were prepared by saturating (impregnating) the back side of a grade P150, E weight coated abrasive belt ("3M 241 RESINITE") with an aqueous dispersion containing carbon black and graphite (commercially available under the trade designation "ELECTRODAG 112" from Acheson Colloids Company of Port Huron, Mich.) which was diluted with water. The amount of the aqueous dispersion and the amount of diluting water for each example is given in Table 2, below. Each saturant belt was dried for about 15 minutes at about 70° C., and then humidified over a weekend at 35% relative humidity. Each belt was then tested as described above in "Procedures for Testing the Coated Abrasive." The results are provided in Table 2, below.

Control C

Control Example B was a grade P150, E weight coated abrasive ("3M 241 RESINITE"). The test results are provided in Table 2, below.

TABLE 2

| Example | Amount of 34% solids aqueous dispersion ("ELECTRODA G 112"), grams | Amount of diluting water, grams | DEF | Cut, grams | Dust collected grams |
|---|---|---|---|---|---|
| 2 | 500 | 375 | 29 | 174 | 6 |
| 3 | 255 | 924 | 53 | 212 | 4 |
| 4 | 256 | 693 | 28 | 228 | 8 |
| 5 | 150 | 623 | 88 | 264 | 3 |
| 6 | 281 | 549 | 48 | 240 | 5 |
| Control C | 0 | 0 | 18 | 189 | 24 |

It can be seen from the above data that the impregnation of the electrically conductive material significantly increased the Dust Efficient Factor of the coated abrasive article.

A cross-section of Example 3 was examined at 20X using a conventional optical stereo microscope. The electrically conductive material appeared to penetrate at least 30 percent into the thickness of the backing.

Comparative I

A cross-section of a grade P120 coated abrasive belt having a sufficient amount of an electrically conductive ink printed on the backside of the backing to reduce the tendency of static electric charge accumulating during the abrading of a workpiece (commercially available under the trade designation "260 UZ XODUCT RESING BOND PAPER OPEN COAT" from the 3M Company) was examined at 20X using a conventional optical stereo microscope. There appeared to be no significant penetration (i.e., less than 0.05 mm) of the electrically conductive ink into the thickness of the backing.

Example 7–11

Each of Examples 7–11 was prepared as follows. A grade P150, E weight coated abrasive belt (commercially available under the trade designation "3M 363I IMPERIAL RESIN BOND" from the 3M Company) was flexed using conventional means, and then placed overnight in a 35% relative humidity cabinet. The belt was removed from the cabinet and the back side was sprayed using conventional means with one of the solutions described below. The amount of material sprayed onto each belt is provided in Table 3, below. The sprayed belt was dried for about 75 minutes at about 75° C., and then placed overnight in a 35% relative humidity cabinet.

For Example 7, the solution comprised about 35% N,N-bis(2-hydroxyethyl)-N-(3″-dedecyloxy-21′hydroxypropyl) methylammonium methosulfate (commercially available from the American Cyanamid Company of Wayne, N.J., under the trade designation "CYSTAT 609"), in a solvent comprising equal amounts of water and isopropanol.

For Example 8, the solution comprised about 35% of stearmidopropy dimethyl-hydroxyethylammonium-dihydrogen phosphate (commercially available from the American Cyanamid Company of Wayne, N.J., under the trade designation "CYSTAT SP") in a solvent comprising equal amounts of water and isopropanol.

For Example 9, the solution comprised 35% stearmidopropyldimethyl B-hydroxyethylammonium nitrate (commercially available from the American Cyanamid Company of Wayne, N.J., under the trade designation of "CYSTAT SN") in a solvent comprising equal amounts of water and isopropanol.

For Example 10, the solution comprised about 35% 3-lauramidopropyl trimethylammonium methylsulfate (commercially available from the American Cyanamid Company of Wayne, N.J., under the trade designation "CYSTAT LS") in a solvent comprising equal amounts of water and isopropanol.

For Example 11, the solution comprised about 35% of a quaternary salt ("EMERSTAT 6660A") in equal amounts of water and isopropanol.

Each belt was tested as described above in "Procedures for Testing the Coated Abrasive." The results are provided in Table 3, below.

Control Example D

Control Example D was a grade P150, weight coated abrasive belt ("3M 363I IMPERIAL RESIN BOND"). The belt was humidified overnight at about 35% relative humidity and then tested as described above in "Procedures for Testing the Coated Abrasive." The results are provided in Table 3, below.

TABLE 3

| Examples | Amount of solution coated, grams | DEF | Cut, grams | Dust collected, grams |
|---|---|---|---|---|
| Control D | 0 | 6 | 830 | 142 |
| 7 | 8.1 | 27 | 781 | 29 |
| 8 | 19.9 | 35 | 911 | 26 |
| 9 | 12.5 | 41 | 855 | 21 |
| 10 | 7.6 | 38 | 942 | 25 |
| 11 | 6.3 | 39 | 810 | 21 |

It can be seen from the above data that the use of the electrically conductive material significantly increased the Dust Efficiency Factor of the coated abrasive article.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of making a coated abrasive article having a reduced tendency to accumulate static electric charge during the abrading of a workpiece, said method comprising the steps of:

(a) providing a coated abrasive article comprising a backing having a front surface bearing an abrasive layer and a porous back surface;

(b) impregnating said porous back surface so as to penetrate at least 0.005 mm into the thickness of said backing with an impregnating composition comprising a plurality of electrically conductive particles dispersed in a liquid vehicle to provide on removal of at least a portion of said liquid, a sufficient amount of said electrically conductive particles in said backing such that said coated abrasive article has a reduced tendency to accumulate static electric charge during said abrading, said impregnating composition being essentially free of binder adhesive; and (c) at least partially removing a sufficient amount of liquid to provide said coated abrasive article.

2. The method according to claim 1 wherein said backing is made of cellulose fibers.

3. The method according to claim 2 wherein said backing is nonwoven.

4. The method according to claim 3 wherein said backing is at least 0.2 mm thick.

5. The method according to claim 4 wherein said abrasive layer is applied by a process comprising the steps of:

(i) applying a make coat precursor to said front surface;

(ii) projecting a plurality of abrasive granules into said make coat precursor;

(iii) at least partially curing said make coat precursor;

(iv) applying a size coat precursor over said at least partially cured make coat and said abrasive granules; and (v) curing said size coat precursor.

6. The method according to claim 4 wherein said abrasive layer is applied by a process comprising the steps of:

(i) applying a slurry coat comprising a bond system precursor and abrasive granules onto said front surface; and (ii) curing said bond system precursor.

7. The method according to claim 4 wherein said liquid vehicle is water and said solvent is organic liquid.

8. The method according to claim 7 wherein said organic liquid is selected from the group consisting of mineral spirits, oil, alcohols, acetone, glycols, xylene, and combinations thereof.

9. The method according to claim 3 wherein said backing has a thickness in the range from about 0.2 to about 0.4 mm.

10. The method according to claim 4 wherein said electrically conductive particles are made of a material selected from the group consisting of carbon black, graphite, and combinations thereof.

11. The method according to claim 10 wherein said carbon black particles have an average diameter in the range from about 10 to about 90 nm.

12. The method according to claim 10 wherein said graphite particles have an average diameter in the range from about 0.5 to about 15 micrometers.

13. The method according to claim 4 wherein said backing comprises about 2 to about 10 percent by weight of said electrically conductive material, based on the combined weight of said backing and said electrically conductive material.

14. The method according to claim 4 wherein said dispersion further comprises at least one dispersion aid.

15. The method according to claim 14 wherein said dispersion aid is selected from the group consisting of sulfonated sodium lignosulfonates, neutralized salts of condensed naphthalene sulfonic acid, anionic polymerized naphthalene sulfonate, and combinations thereof.

16. The method according to claim 4, further comprising the step of applying a supersize coat onto said abrasive layer.

17. The method according to claim 4 wherein said liquid medium is partially removed in step (c).

* * * * *

UNITED STATES PATENT AND TRADEMARK OFFICE

CERTIFICATE OF CORRECTION

PATENT NO. : 5,328,716
DATED : July 12, 1994
INVENTOR(S) : Buchanan

It is certified that error appears in the above-indentified patent and that said Letters Patent is hereby corrected as shown below:

Col. 9, lines 51/52, "XODUCT RESING" should be --XODUST RESIN--.

Signed and Sealed this

Twentieth Day of December, 1994

*Attest:*

Bruce Lehman

BRUCE LEHMAN

*Attesting Officer*

*Commissioner of Patents and Trademarks*